United States Patent [19]

Day

[11] 4,001,355

[45] Jan. 4, 1977

[54] CARBURETOR

[76] Inventor: Kenneth Edwin Day, 14, Riversdale Road, Thames Ditton, Surrey, England

[22] Filed: July 10, 1975

[21] Appl. No.: 594,611

[30] Foreign Application Priority Data

July 12, 1974 United Kingdom ..... 31088/74

[52] U.S. Cl. ..... 261/44 R; 261/67; 261/71; 261/DIG. 2

[51] Int. Cl.[2] ..... F02M 9/08

[58] Field of Search ..... 261/44 R, 44 A, 67, 261/71, DIG. 2

[56] References Cited

UNITED STATES PATENTS

| | | | |
|---|---|---|---|
| 795,357 | 7/1905 | Maxwell | 261/44 A |
| 1,563,705 | 12/1925 | Ellehammer | 261/44 A |
| 1,863,402 | 6/1932 | Halm | 261/44 A |
| 2,926,007 | 2/1960 | Pettit | 261/DIG. 2 |
| 2,995,349 | 8/1961 | Kennedy, Sr. | 261/44 R |
| 3,547,415 | 12/1970 | Perry | 261/DIG. 2 |
| 3,711,068 | 1/1973 | Perry | 261/44 A |
| 3,784,174 | 1/1974 | Tarnofsky | 261/DIG. 2 |

FOREIGN PATENTS OR APPLICATIONS

| | | | |
|---|---|---|---|
| 609,684 | 5/1926 | France | 261/44 A |
| 493,733 | 3/1930 | Germany | 261/44 R |
| 113,803 | 12/1924 | Switzerland | 261/44 A |

*Primary Examiner*—Tim R. Miles
*Attorney, Agent, or Firm*—Parmelee, Miller, Welsh & Kratz

[57] ABSTRACT

A carburetor comprising a body, means to secure the body to an engine, a barrel rockably mounted in the body and means for rocking said barrel means defining a passage extending through the body and the barrel to an engine which passage can be restricted by rotation of the barrel relative to the body, the part of the passage through the body and the barrel being tapered down to the trailing edge of the barrel, the barrel having a fuel passage way defined therein extending from a tapering slot in the circumferential edge of the barrel to an opening adjacent said trailing edge of the barrel, which opening always communicates with said passage extending through said body and said barrel in all operative positions of the barrel, the tapering slot being adjacent a hole extending through the body and leading to a fuel control valve so that movement of the barrel alters the cross section of said tapering slot presented to said hole to meter the quantity of fuel to be passed through said tapering slot.

10 Claims, 4 Drawing Figures

CARBURETOR

Figure 1:
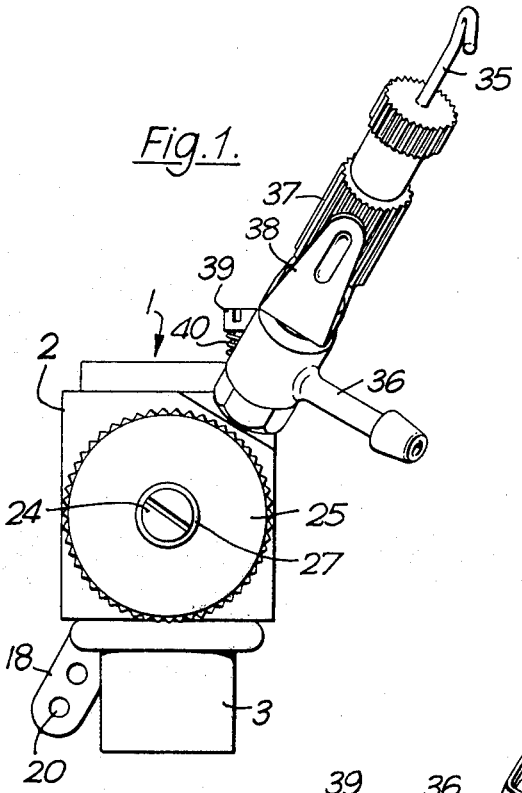

This invention relates to a carburettor, more particularly a carburettor for model two-stroke internal combustion engines.

It is desirable that the speed of a model engine should be controllable by a single remotely operated control. It is important that an engine should not only be able to idle for lengthy periods but also that it should be able to pick up speed quickly with minimum hesitation from both its slowest and any intermediate speed. The main object of this invention is to provide a carburettor which will fulfil these requirements and also give optimum fuel and air settings to ensure that an engine gives its maximum performance, while at the same time giving good fuel economy. A secondary object of this invention is to reduce the risk of injury to an operative, that is by a propeller or the like driven by the engine, if and when it is necessary to effect an adjustment, for example to a main fuel setting control needle.

According to one aspect of this invention there is provided a carburettor comprising a body, means to secure the body to an engine, a barrel rockably mounted in the body and means for rocking said barrel means defining a passage extending through the body and the barrel to an engine which passage can be restricted by rotation of the barrel relative to the body, the part of the passage through the body and the barrel being tapered down to the trailing edge of the barrel, the barrel having a fuel passage way defined therein extending from a tapering slot in the circumferential edge of the barrel to an opening adjacent said trailing edge of the barrel, which opening always communicates with said passage extending through said body and said barrel in all operative positions of the barrel, the tapering slot being adjacent a hole extending through the body and leading to a fuel control valve so that movement of the barrel alters the cross section of said tapering slot presented to said hole to meter the quantity of fuel to be passed through said tapering slot.

According to another aspect of this invention there is provided a carburettor comprising a body provided with a spigot adapted to fit an engine carburettor socket; a barrel rockably mounted in the body with its axis extending transversely of the spigot, the body, barrel and spigot being formed so as to define a continuous bore extending through them which can be restricted by rotation of the barrel with respect to the body and the spigot, the part of the bore through the body and the barrel being tapered down through to the trailing edge of the barrel; a sleeve member disposed around the barrel and having formed therein a slot of varying size, this slot being coincident with firstly a hole extending through the body and leading to a needle valve for controlling initially admission of fuel and secondly a drilling extending through the barrel and terminating at the trailing edge thereof at a point in which it always opens into the said bore in all operative positions of the barrel; and means for rocking the barrel with respect to the body so that the slot in the sleeve serves to control the supply of fuel passing to and through the drilling in the barrel.

The means for rocking the barrel preferably comprises a lever carried by the barrel and adapted to be linked to a remote control servo mechanism.

According to a feature of this invention the said hole extending through the body is disposed obliquely relative to said spigot so that access to the needle valve is facilitated when the carburettor is fixed, for example, to a motor driving a propeller, e.g. on a model aeroplane.

Figure 2:
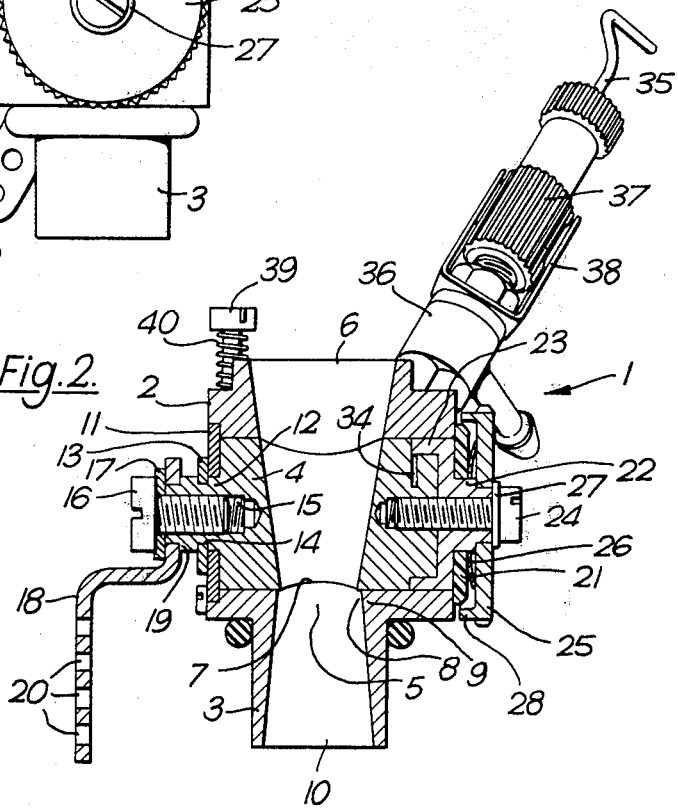
Figure 3:
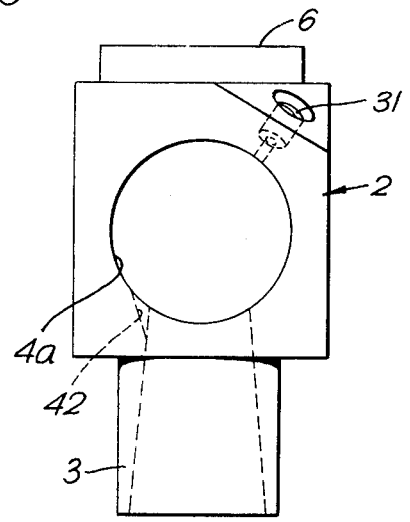
Figure 4:
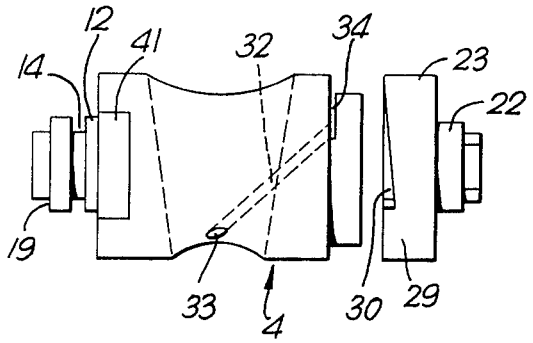

In order that the invention may be more readily understood and so that further features thereof may be appreciated the invention will now be described by way of example with reference to the accompanying drawings in which:

FIG. 1 is a side elevational view of a carburettor in accordance with this invention, FIG. 2 is a vertical sectional view of the carburettor of FIG. 1, FIG. 3 is an end view of the body of the carburettor of FIG. 1, and FIG. 4 is an exploded view of the barrel of the carburettor shown in FIGS. 1 and 2.

Referring to the drawings a carburettor 1, comprises a body 2 provided with a hollow spigot 3 adapted to fit into an engine carburettor socket (not shown). The spigot 3 may be made to fit the smallest engine carburettor socket, being adaptable by means of sleeves or the like applied thereto to fit larger sockets.

Rockably mounted in the body 2, above and extending transversely of the spigot 3, is a barrel 4. Extending through the body 2, the barrel 4 and the spigot 3 is a bore 5, rotation of the barrel 4 in the body 2 serving to form a restriction in such bore 5. With the barrel 4 in its position to cause no such restriction, the bore 5 through the body 2 and the barrel 4 tapers inwardly, that is from the upper or outer end 6 of the body 2 down through to the trailing edge 7 of the barrel 4. The end of this part of the bore 5, that is through the barrel 4, is, at its narrowest point 7, smaller than the adjacent part 8 of the bore in the lower or inner part 9 of the body 2, this part leading into the part of the bore 5 through the spigot 3, which part of the bore 5 is tapered outwardly towards its lower end 10.

The barrel 4 is disposed in a generally cylindrical chamber **4*a* which extends through the body 2 transversely of the aforesaid bore 5, that is the bore 5 through the body 2, barrel 4 and spigot 3. At one end the cylindrical chamber 4*a* is closed by an end plate 11 which fits into a coaxially disposed recess of slightly larger diameter and is secured therein by means of screws passing into the body 2 the heads of the screws engaging with the peripheral edge portion of the end plate 11. Centrally the end plate is formed with an aperture through which passes freely a stem 12 provided on the adjacent end of the barrel 4, the stem being located on the outside of the plate 11 by a circlip 13 that engages with a recess 14 provided in the stem 12. The stem has a threaded bore 15 in its outer end face and in this engages a screw 16 carrying a washer 17 and one end of a lever 18 the lever being located in position by the washer 17 and a shoulder 19 provided on the stem 12. This lever 18 is adapted for linkage to a remote control servo mechanism, and a plurality of apertures 20 are formed in the lever 17**.

Located at the other end of the chamber is an end cap 21 which is also provided centrally with an aperture. Through this aperture passes freely a boss 22 provided on a cup-shaped member 23 which forms a sleeve around the adjacent end of the barrel 4, such end being correspondingly reduced in diameter, that is so that the sleeve 23 can be accommodated within the chamber.

Passing through the boss 22 of the sleeve member and into a blind internally threaded bore provided at the end of the barrel 4 is a screw 24 on the end of which, that is on the outside of the end cap 21, is a control wheel 25, a spring washer 26 being disposed between the inner face of the control wheel 25 and the outer face of the end cap 21, and a further washer 27 being provided between the outer face of the control wheel 25 and the head of the screw 24. The boss 22 is provided with a flat region on the otherwise cylindrical surface thereof and the control wheel 25 has a central aperture having a shape corresponding to the cross section of the boss 22 so that when the control wheel 25 is engaged with the boss 22 rotation of the control wheel will result in rotation of the sleeve 23. The outer peripheral edge of the control wheel 25 is knurled and the control wheel is provided with an inwardly directed peripheral flange 28 which affords some protection to the spring washer 26.

From the foregoing description it will be appreciated that if the lever 18 on the barrel stem 12 is held, then by turning the control wheel 25 the relative position of the sleeve member 23 and barrel 4 can be varied. It is, of course, necessary to slacken the screw 24 which passes through the control wheel 25 and the boss 22 of the sleeve member 23 before the control wheel 25 can be turned.

Formed in the cylindrical wall 29 of the sleeve member is a slot 30, which is tapered so that the effective operative size of the slot can be varied. This slot 30 is disposed so that it is coincident with a hole 31 extending obliquely through the body 2 to one side of the bore 5 through it. The hole 31 has a narrow portion to permit the accurate metering of fuel flowing through the hole 31. The slot 30 also communicates with a passage way 32 extending obliquely through the barrel 4 and terminating at one end adjacent 33, the point of smallest diameter of the part of the bore through the barrel. The passage way 32 is straight so that the flow of fuel therethrough is not impeded in any way. The end 33 of the passage way 32 is arranged so that it always opens into the bore 5 in all operative positions of the barrel 4. The end of the passage way 32 adjacent the slot 30 is in the form of a channel 34 defined in that part of the barrel 4 that is embraced by the cylindrical wall 29 of sleeve 23. The channel 34 communicates with the tapering slot 30 over a wide range of adjustment of the sleeve 23 relative to the barrel 4. A notch 42 is formed in the body 2 adjacent the part of the bore 5 extending therethrough so that, when the barrel 4 is rotated so that the portion of the bore 5 defined by the barrel 4 is co-aligned with the portions of the bore 5 in the body 2 and the spigot 3 (i.e. the fully open position) the end 33 of the passage way 32 is not blocked, but communicates with the bore through the notch 42.

The hole 31 extending obliquely through the body 2 leads to a main needle valve 35 through which fuel passes initially, that is through a so-called banjo 36. The setting of the needle valve 35, which is prevented from moving by a ratchet 37 and spring 38 device, is such that maximum fuel passes into and through the hole 31 in the body 2. Fuel then passes through the slot 30 in the sleeve member 33 and so to and through the passage way 32 in the barrel. However, by setting the position of the sleeve member 23 in relation to the barrel 4 the amount of fuel which passes initially through the slot 30 and so to the passage way 32 in the barrel can be regulated with considerable accuracy. In operation, when the lever 18 on the barrel stem 12 is moved to rotate the barrel further adjustment of fuel supply takes place, since the cross section of the portion of the slot 30 adjacent the end of hole 31 will vary, thus metering the quantity of fuel admitted to the passage way 32.

Since the fuel emerges into the bore 5 through the body 2, barrel 4 and spigot 3 adjacent the point of smallest diameter 7 in the immediate vicinity of a sudden increase in diameter 8, there is considerable turbulence in air flow which assists the vaporization of fuel, and mixing of the fuel and air.

The passage for fuel between the sleeve 23 and the outlet 33 in the bore 5 is short and direct. This ensures a rapid pick-up from idling or intermediate speed to a faster speed. Moreover the disposition of the sleeve 23 ensures that pockets or reservoirs of fuel do not form resulting temporarily in a poor engine performance.

To regulate the limits of possible positioning of the barrel 4 a slot or flattened surface 41 is provided in the barrel 4, and a screw 39 which passes adjustably through the body 2 engages in this slot or flattened surface 41. The arrangement is such that in a fully open position the screw 39 is disposed at a point along the slot but in a fully closed position the end of the screw engages one end of the slot. To prevent the screw 39 vibrating a coil spring 40 is mounted thereon between its head and the outer surface of the body.

The main needle valve 35, being coaxial with the hole 31 extending obliquely through the body will, when the carburettor is applied to the engine of a model aircraft, be inclined away from the propellor of the aircraft and not disposed in a plane parallel and close to the plane in which the propellor rotates. Thus should any adjustment of the needle valve 35 be required there is little likelihood of an operative's fingers being injured by the rotating propellor.

From the foregoing it will be appreciated that as the barrel is turned to increase the effective cross section of the bore through the body and the barrel, thus increasing the flow of air to the engine, the cross section of the tapering slot presented to the hole containing the needle valve is also increased, thus increasing the flow of fuel to the engine.

It is to be understood that the above described carburettor is primarily intended for use with a model aircraft engine that drives a propellor. However, carburettors in accordance with this invention may be used on many engines, and the positioning of the needle valve 35 may be different in some embodiments intended for specific uses. For example the needle valve may be parallel to the axis of rotation of the barrel, or perpendicular to that axis. Also, in other embodiments of the invention the spigot can be replaced by any other means suitable for securing the body to an engine, such as a flange.

I claim:

1. A carburettor comprising a body provided with fuel control valve means, means to secure the body to an engine, a barrel rockably mounted in the body and means for rocking said barrel, means defining a passage extending through the body and the barrel to the engine which passage can be restricted by rotation of the barrel relative to the body, the part of the passage through the body and the barrel being tapered down to the trailing edge of the barrel, the barrel being provided with a sleeve member embracing part thereof, said sleeve member having a circumferential tapering slot, the barrel having a fuel passageway defined therein extending from said tapering slot in the circumferential edge of the sleeve member to an opening adjacent said trailing edge of the barrel, which opening also communicates with said passage extending through said body and said barrel in all operative positions of the barrel, the tapering slot being adjacent a hole extending through the body and leading to said fuel control valve means so that movement of the barrel alters the cross section of said tapering slot presented to said hole to meter the quantity of fuel to be passed through said tapering slot and further including means for rotating said sleeve relative to said barrel to adjust the position of said tapering slot relative to said passageway extending through said barrel.

2. A carburettor according to claim 1 wherein said barrel is provided with a recessed channel therein which communicates with said tapering slot over a wide range of adjustment of said sleeve relative to said barrel, there being a direct fuel passage way extending from said channel to said opening adjacent the trailing edge of the barrel.

3. A carburettor according to claim 1 wherein the diameter of said passage way in said barrel adjacent the trailing edge thereof is less than the diameter of the passage way in the body adjacent the trailing edge of the barrel.

4. A carburettor according to claim 1 wherein adjustable means are provided for limiting the rocking motion of said barrel.

5. A carburettor according to claim 1, wherein the means for rocking the barrel comprise a lever carried by the barrel and adapted to be linked to a remote control servo-mechanism.

6. A carburettor according to claim 1 wherein the body is provided with a spigot adapted to secure the carburettor to an engine carburettor socket, said passage way being in the form of a bore extending through said body, barrel and spigot.

7. A carburettor according to claim 6, wherein said fuel control valve comprises a needle valve located in a hole extending through the body obliquely to said spigot.

8. A carburettor comprising a body provided with a needle valve and a spigot adapted to fit an engine carburettor socket; a barrel rockably mounted in the body with its axis extending transversely of the spigot, the body, barrel and spigot being formed so as to define a continuous bore extending through them which can be restricted by rotation of the barrel with respect to the body and the spigot, the part of the bore through the body and the barrel being tapered down through to the trailing edge of the barrel; a sleeve member disposed around the barrel and having formed therein a slot of varying size, this slot being coincident with firstly a hole extending through the body and leading to said needle valve for controlling initially admission of fuel and secondly a drilling extending through the barrel and terminating at the trailing edge thereof at a point in which it always opens into the said bore in all operative positions of the barrel; and means for rocking the barrel with respect to the body so that the slot in the sleeve serves to control the supply of fuel passing to and through the drilling in the barrel.

9. A carburettor according to claim 8 wherein said hole extending through the body is disposed obliquely relative to said spigot.

10. A carburettor according to claim 8, wherein the means for rocking the barrel comprise a lever carried by the barrel and adapted to be linked to a remote control servo-mechanism.

* * * * *